United States Patent [19]

Smith

[11] 4,220,089

[45] Sep. 2, 1980

[54] CARTRIDGE FOR A FULLY TELESCOPED PROJECTILE

[75] Inventor: William G. Smith, Burns, Tenn.

[73] Assignee: The United States of America as represented by the Secretary of the Army, Washington, D.C.

[21] Appl. No.: 927,447

[22] Filed: Jul. 24, 1978

[51] Int. Cl.[3] ..... F42B 5/02

[52] U.S. Cl. ..... 102/38 R; 102/39; 102/40; 102/43 R

[58] Field of Search ..... 86/39; 102/38 R, 38 CC, 102/39, 40, 43 R, 43 F, 43 C

[56] References Cited

U.S. PATENT DOCUMENTS

| | | | |
|---|---|---|---|
| 3,009,394 | 11/1961 | Kamp et al. | 102/38 R X |
| 3,093,073 | 6/1963 | Lockwood et al. | 102/43 P |
| 3,138,056 | 6/1964 | Covey | 86/39 |
| 3,354,571 | 11/1967 | Parker | 102/43 C X |
| 3,596,600 | 8/1971 | Himmelsbach, Jr. | 102/43 C |

FOREIGN PATENT DOCUMENTS

| | | | |
|---|---|---|---|
| 1314489 | 12/1962 | France | 102/43 C |

*Primary Examiner*—Harold J. Tudor
*Attorney, Agent, or Firm*—Nathan Edelberg; Robert P. Gibson; Max Yarmovsky

[57] ABSTRACT

A forward end of a cup shaped tubular cartridge case utilizes a divergently tapered exterior wall and a straight sided interior wall to permit initial assembly of a fully telescoped projectile therein and subsequent reliable sealing of the cartridge case by a convergent seal member. After sealing the divergently tapered exterior wall of the cartridge case is converted to a convergently tapered wall preventing separation of the seal member from the cartridge case during projectile launch.

6 Claims, 8 Drawing Figures

CARTRIDGE FOR A FULLY TELESCOPED PROJECTILE

GOVERNMENTAL INTEREST

The invention described herein may be manufactured, used and licensed by or for the Government for governmental purposes without the payment to me of any royalty thereon.

BACKGROUND OF THE INVENTION

Various means have been used in the prior art to seal the front open end of a fully telescoped projectile in a cartridge case. Usually the seal is made by rolling the open end of the cartridge case over a disc type element. Normally the lip produced by this roll forming operation has a relatively large radius. When the cartridge case is pushed into the breech of the gun and the breech locked so that the cartridge case open end is in abutment with the barrel assembly, the cartridge case lip is slightly crushed forming a static seal. One of the problems with this prior art front seal has been the severe stretching of the case material which occurs when the lip seal is reformed after being subjected to a firing pressure of 40–50,000 p.s.i. Since a crack generally exists between the barrel end and the breech assembly some unwanted extrusion of the case lip material usually occurs which tends to inhibit automatic removal of the spent cartridge case.

In other prior art designs, where a "L" cross-sectional seal has replaced the disc end seal with a rolled cartridge case lip, there has been problems in retaining the seal in the cartridge case after firing.

SUMMARY OF THE INVENTION

The present invention relates to a cartridge case seal assembly which converts a divergently tapered cartridge case to a convergently tapered case. The convergently tapered case prevents separation of the seal from the case during firing of a telescoped projectile.

An object of the present invention is to provide a cartridge case seal assembly for a fully telescoped projectile which does not have a lip seal which extrudes into a crack between a barrel end and a breech assembly.

Another object of the present invention is to provide a cartridge case-seal assembly which does not permit undue propellant gas leakage between a case and seal member interface.

A further object of the present invention is to provide a one piece "L" seal-cartridge case assembly having a diverging tapered case end which is converted to a converging tapered case end. The converging taper end prevents separation of the seal member from the cartridge case during firing of the cartridge.

For a better understanding of the present invention, together with other and further objects thereof, reference is made to the following descriptions taken in connection with the accompanying drawings.

BRIEF DESCRIPTION OF THE DRAWINGS

Throughout the following description like reference numerals are used to donate like parts of the drawings.

DESCRIPTION OF THE PREFERRED EMBODIMENTS

Figure 1:
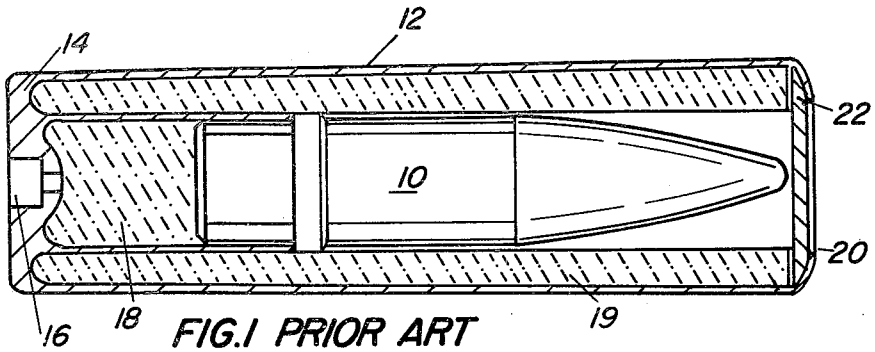
FIG. 1 PRIOR ART
FIG. 1 is a longitudinal diametral cross-sectional view of a prior art fully telescoped projectile in a rolled lip type seal cartridge case.

Referring now to FIG. 1 a prior art design for a fully telescoped projectile 10 in a cartridge case-seal assembly comprises a tubular housing 12 having a closed end 14 which contains an axially disposed impact primer member 16. Primer 16 initiates a consolidated propellant charge 18 which in turn initiates annular consolidated charge 19. The open end of housing 12 has a rolled lip 20 which encloses therein an environmental disk shaped seal member 22.

Figure 2:
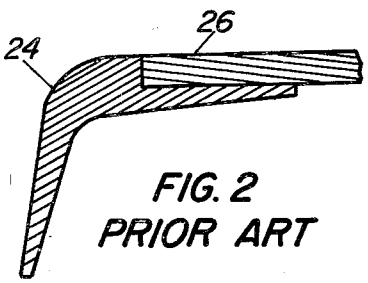
FIG. 2 PRIOR ART
FIG. 2 is a partial cross-sectional view of a prior art seal and cartridge case showing the assembly in a free condition.

FIGS. 2–5 show the cartridge case-seal end of a prior art design showing an "L" shaped seal 24 assembled to the open end of a cartridge case 26. FIG. 2 shows the assembly in a free condition before the cartridge is placed into a breech of a weapon.

Figure 3:
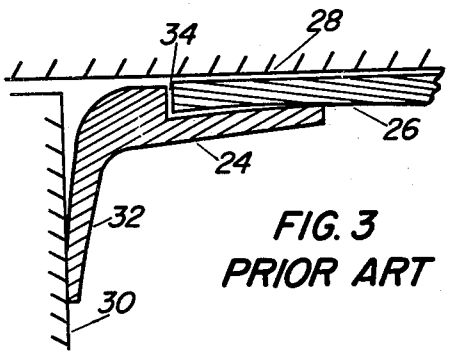
FIG. 3 PRIOR ART
FIG. 3 is a partial cross-sectional view of the cartridge case-seal assembly shown in FIG. 2 after it has been positioned in a weapon chamber against a barrel just prior to being fired.
Figure 4:
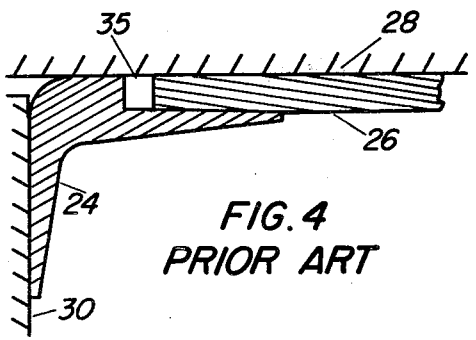
FIG. 4 PRIOR ART
FIG. 4 is a partial cross-sectional view of the drawings of the case-seal assembly shown in FIGS. 2 and 3 after the case has been pressurized.
Figure 5:
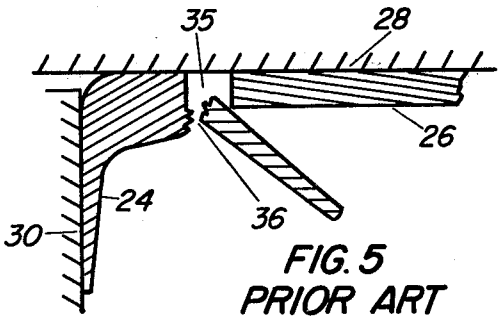
FIG. 5 PRIOR ART
FIG. 5 is partial cross-sectional view of the case-seal assembly drawings shown in FIGS. 2–4 showing a type of failure of the seal in the prior art design.

FIG. 3 shows the unfired assembly of the cartridge case-seal after it has been inserted in a weapon chamber 28 and pushed forward against a barrel face 30 deforming the leading edge 32 of seal 24. The deformation causes a separation between seal shoulder 34 and case 26. FIG. 4 shows the assembly after the projectile has been fired and the chamber pressurized by the propellant gases. The gases cause the case to expand in the chamber 28 and open an expansion gap 35 to a greater extent. FIG. 4 shows where the usual shear failure 36 occurs in seal 24. Failure in this area generally results in loss of propellant gas pressure and shortness of projectile's ability to reach its intended range.

Figure 6:
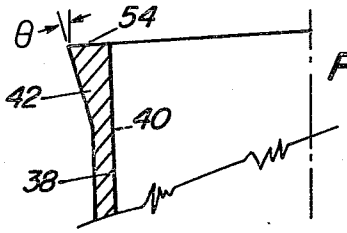
FIG. 6 is a partial cross-sectional view of the present invention cartridge case divergently tapered open end prior to assembly with a seal member.
Figure 7:
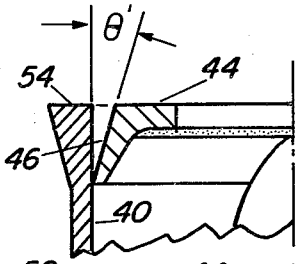
FIG. 7 is a partial cross-sectional view of a convergently tapered seal member disposed in cartridge case prior to sealing.
Figure 8:
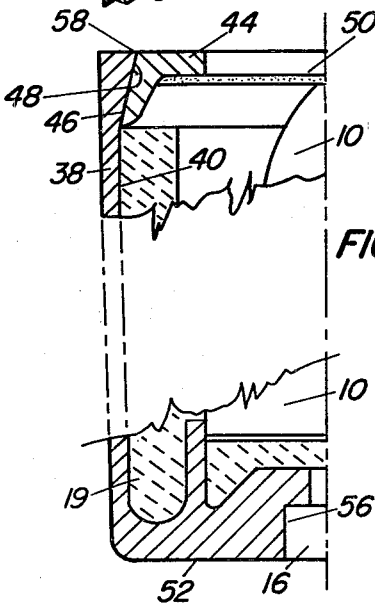
FIG. 8 is a partial cross-sectional view of the assembled cartridge case-seal assembly of the present invention.

Referring now to the present invention in FIGS. 6–8, unformed tubular housing 38 has a straight sided interior wall 40 and a divergently tapered exterior wall 42. Exterior wall 42 is tapered to make an angle $\theta$. $\theta$ is equal to an angle of divergence that the exterior wall surface 42 makes with a line parallel to the straight sided interior wall 40. An annular seal element 44, having an "L" shaped cross-sectional area, has a convergently tapered peripheral side 46. Tapered seal side 46 is oppositely tapered away from the unformed interior wall 40 by a convergent angle $\theta'$. $\theta'$ in this instance is equal to the divergent angle $\theta$. The length of the tapers of the exterior wall 40 and the seal taper 46 are also made equal. FIG. 8 shows that in order to complete the assembly of the telescoped projectile 10 in housing 38, the exterior divergently tapered wall 42 is forcibly pushed radially inward until the formed interior case wall 48 seals against seal member taper 46. Projectile 10 is restrained by a disk shaped environmental forward closure member 50. Closure member 50 may be made of material such as polystyrene foam.

In operation, the cartridge case-seal fully telescoped projectile assembly is made by first forming a tubular cup shaped housing having a partially closed rear end 52 and a diverently tapered open front end 54. The next step comprises loading of an impact primer 16 axially in primer case bore 56. A third step includes operatively positioning consolidated propellant charges 18 and 19 in the cartridge case or housing 38. The fourth step includes axially operatively positioning a projectile 10 in the propellant charge 19. The next step is to load an environmental seal member 50 on top of the forward end of the projectile 10. Positioning the environmental seal 50 in a convergently formed "L" seal member 44 so that the environmental seal member 50 is intermediate the forward ogive end of the projectile 10 and convergent taper section 44 is transversely aligned with the divergent taper section 42 of the case 38. The final step comprises rolling the divergent taper exterior wall radially inward until the interior case wall 40 is converted to a convergent taper forming a contacting annular seal surface 58 with seal member taper 46.

While there has been described and illustrated specific embodiments of the invention, it will be obvious that various changes, modifications and additions can be made herein without departing from the field of the invention which should be limited only by the scope of the appended claims.

Having thus fully described the invention, what is claimed as new and desired to be secured by Letters Patent of the United States is:

1. A cartridge which comprises:

a fully telescoped and environmentally protected projectile;

tubular housing means for operatively holding said telescoped projectile therein which includes a convergently tapered open front end interior wall and a partially closed rear end, said rear end having an axially disposed primer bore therein, said convergently tapered open front end has an exterior straight sided wall coverted from a divergently tapered wall having a divergent angle $\theta$;

propellant means operatively disposed in said housing means for forcibly ejecting said projectile from said housing means;

primer means fixedly positioned in said primer bore for initiating said propellant means;

seal member means comprising an annular shaped element having a convergently tapered peripheral side and an environmental forward closure member, disposed in said convergently tapered open front end of said housing means and interfacing therewith in an annular seal, for retaining said projectile in a fully telescoped position within said housing means and environmentally protecting said projectile prior to activation of said primer means, said annular seal preventing separation of said annular shaped element from said housing means during firing of said cartridge, and for preventing escape of propellant gas between said annular shaped element and said housing means.

2. A cartridge as recited in claim 1 wherein said interior wall of said open front end of said housing means is convergently tapered with respect to said exterior straight sided wall at a convergent angle $\theta'$.

3. A cartridge as recited in claim 2 wherein said divergent angle $\theta$ and convergent angle $\theta'$ are equal.

4. A cartridge as recited in claim 3 wherein said seal member means comprises:

an annular "L" cross-section shaped element having a convergently tapered peripheral side; and a disk shaped environmental forward closure member disposed intermediate said annular "L" cross-section shaped seal element and the forward end of said projectile.

5. A method of sealing a fully telescoped projectile in a cartridge case which comprises the steps of:

forming a tubular cup shaped housing having a partially closed rear end, an open front end having a divergently tapered exterior wall and a straight sided interior wall;

loading an impact primer in said partially closed rear end of said housing;

positioning consolidated propellant charge material in said housing;

axially positioning a projectile in said propellant charge material;

loading an environmental seal on top of a forward end of said projectile;

positioning a convergently formed "L" shaped cross-sectional seal member in said housing to operatively dispose said environmental seal intermediate said forward end of said projectile and said "L" shaped cross-sectional seal member, and transversely aligning a convergent taper section of said "L" shaped cross-sectional seal member with said divergently tapered open end of said housing; and rolling said divergently tapered exterior wall of the open front end of said housing radially inward until said interior wall of said housing is converted to form a contacting annular seal surface with said convergent taper section of said "L" shaped cross-sectional seal member and the exterior wall is converted to form a straight side.

6. A method of sealing a fully telescoped projectile as recited in claim 5 wherein said forming step includes making an angle of divergence of said divergently tapered exterior wall of said housing equal to an angle of convergence of said taper section of said "L" shaped cross-sectional seal member.

* * * * *